US009579916B2

(12) United States Patent
Matsumori et al.

(10) Patent No.: US 9,579,916 B2
(45) Date of Patent: Feb. 28, 2017

(54) THERMOSENSITIVE RECORDING MEDIUM

(71) Applicant: Nippon Paper Industries Co., Ltd., Tokyo (JP)

(72) Inventors: Yasuaki Matsumori, Tokyo (JP); Akihito Ogino, Tokyo (JP); Yoshimi Midorikawa, Tokyo (JP); Yoshihide Watanabe, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 15/025,438

(22) PCT Filed: Sep. 25, 2014

(86) PCT No.: PCT/JP2014/075381
§ 371 (c)(1),
(2) Date: Mar. 28, 2016

(87) PCT Pub. No.: WO2015/046305
PCT Pub. Date: Apr. 2, 2015

(65) Prior Publication Data

US 2016/0236497 A1 Aug. 18, 2016

(30) Foreign Application Priority Data

Sep. 30, 2013 (JP) ..... 2013-204200

(51) Int. Cl.

| | |
|---|---|
| ***B41M 5/44*** | (2006.01) |
| ***B41M 5/52*** | (2006.01) |
| ***B41M 5/42*** | (2006.01) |
| ***B41M 5/323*** | (2006.01) |
| ***B41M 5/333*** | (2006.01) |
| ***B41M 5/327*** | (2006.01) |
| ***B41M 5/50*** | (2006.01) |

(52) U.S. Cl.
CPC ..... *B41M 5/529* (2013.01); *B41M 5/323* (2013.01); *B41M 5/3275* (2013.01); *B41M 5/333* (2013.01); *B41M 5/42* (2013.01); *B41M 5/44* (2013.01); *B41M 5/443* (2013.01); *B41M 5/506* (2013.01); *B41M 5/5254* (2013.01); *B41M 5/5281* (2013.01); *B41M 2205/04* (2013.01); *B41M 2205/38* (2013.01); *B41M 2205/40* (2013.01)

(58) Field of Classification Search
CPC . B41M 5/40; B41M 5/42; B41M 5/44; B41M 5/443; B41M 2205/04; B41M 2205/38; B41M 2205/40
USPC ..... 503/226
See application file for complete search history.

(56) References Cited

U.S. PATENT DOCUMENTS

| | | | |
|---|---|---|---|
| 8,129,307 | B2 | 3/2012 | Makihara et al. |
| 8,247,347 | B2 | 8/2012 | Takagi et al. |
| 8,283,284 | B2 | 10/2012 | Hirai et al. |
| 8,466,085 | B2 | 6/2013 | Kato et al. |
| 8,492,308 | B2 | 7/2013 | Kurihara et al. |
| 8,609,582 | B2 | 12/2013 | Hirai et al. |
| 8,673,812 | B2 | 3/2014 | Ohse et al. |
| 8,722,576 | B2 | 5/2014 | Hayakawa et al. |
| 2011/0269622 | A1 | 11/2011 | Ohse et al. |

FOREIGN PATENT DOCUMENTS

| | | | |
|---|---|---|---|
| JP | H5/246140 | | 9/1993 |
| JP | 6/64326 | A | 3/1994 |
| JP | 9/175027 | A | 7/1997 |
| JP | 10/166736 | A | 6/1998 |
| JP | H10/217609 | | 8/1998 |
| JP | H10/258577 | | 9/1998 |
| JP | 2000/355165 | A | 12/2000 |
| JP | 2002/301873 | A | 10/2002 |
| JP | 2003/145928 | A | 5/2003 |
| JP | 2003/154760 | A | 5/2003 |
| JP | 2010/214728 | | 9/2010 |
| WO | WO 97/16420 | A1 | 5/1997 |
| WO | WO 02/081229 | A1 | 10/2002 |
| WO | WO 2007/138835 | | 12/2007 |

(Continued)

OTHER PUBLICATIONS

Notification of Transmittal of Translation of the International Preliminary Report on Patentability (Chapter I of Chapter II (PCT Rules 444bis.3(c) and 72.2) for International Patent Application No. PCT/JP2014/075381 dated Apr. 14, 2016.

*Primary Examiner* — Bruce H Hess
(74) *Attorney, Agent, or Firm* — Jenkins, Wilson, Taylor & Hunt

(57) ABSTRACT

The purpose of the present invention is to provide a thermosensitive recording medium with an increased gloss in the blank and printed portions, excellent color developing sensitivity and excellent printing run-ability, particularly excellent printing run-ability at high-speed printing.

Provided is a thermosensitive recording medium having a thermosensitive recording layer comprising a colorless or pale colored basic leuco dye and an electron accepting color developing agent, an intermediate layer and a gloss layer as an outermost layer in this order on a substrate, wherein the intermediate layer is formed by containing a carboxyl group-containing resin and the gloss layer is formed by containing a long chain alkyl group-containing resin and an emulsion type silicone copolymer resin. The long chain alkyl group-containing resin is preferably an acrylic resin containing long-chain alkyl group(s) and the silicone copolymer resin is preferably a silicone-acryl copolymer resin and/or a silicone-urethane copolymer resin.

9 Claims, No Drawings

(56) References Cited

FOREIGN PATENT DOCUMENTS

| | | |
|---|---|---|
| WO | WO 2008/099658 | 8/2008 |
| WO | WO 2008/126635 | 10/2008 |
| WO | WO 2008/139948 | 11/2008 |
| WO | WO 2009/025316 | 2/2009 |
| WO | WO 2009/028118 | 3/2009 |
| WO | WO 2009/119813 | 10/2009 |
| WO | WO 2010/110209 | 9/2010 |
| WO | WO 2010/140662 | 12/2010 |
| WO | WO 2011/001706 | 1/2011 |
| WO | WO 2011/027752 | 3/2011 |
| WO | WO 2011/049159 | 4/2011 |
| WO | WO 2011/114780 | 9/2011 |
| WO | WO 2011/145545 A1 | 11/2011 |
| WO | WO 2013/137243 | 9/2013 |

THERMOSENSITIVE RECORDING MEDIUM

RELATED APPLICATIONS

The application is the U.S. National Stage of PCT International Application No. PCT/JP2014/075381, filed on Sep. 25, 2014, which claims priority to Japanese Patent Application No. 2013-204200, filed on Sep. 30, 2013.

FIELD OF THE INVENTION

The present invention relates to a thermosensitive recording medium for recording image by utilizing a color formation reaction between a colorless or pale colored basic leuco dye (henceforth referred to as "dye") and an electron accepting color developing agent (henceforth referred to as "color developing agent"), which has an increased gloss in the blank and printed portions, excellent color development sensitivity and printing run-ability (mainly anti-sticking property), especially printing run-ability at high speed printing.

BACKGROUND OF THE INVENTION

Thermosensitive recording media are ordinarily prepared by mixing together a colorless or pale-colored electron donating leuco dye and an electron accepting color developing agent, such as a phenolic compound and the like, after grinding them into fine particles, preparing a coating solution by adding a binder, a filler, a sensitivity enhancing agent, a slipping agent and other aids to the mixture and applying the coating solution onto a substrate such as paper, synthetic paper, film, plastic and the like. Thermosensitive recording medium develops color through an instantaneous chemical reaction when heated using a thermal head, hot stamp, hot pen, laser light and the like and yields a recorded image. Thermosensitive recording media are used extensively in recording media such as facsimile devices, computer terminal printers, automatic ticket dispensers, recorders for meters, receipts at super markets and convenience stores and the like.

In recent years, the use of thermosensitive recording media is expanding, such as its use for various ticket, receipts, labels, ATM of Bank, meter reading of gas and electricity, cash vouchers, such as car racing or horseracing betting. Among these applications, for example, in such as ticket and cash vouchers, it is preferred that the thermosensitive recording medium has a high gloss surface to produce a feeling of luxury. Furthermore, among these applications, especially in meter reading of gas and electricity, the demand for high speed printing is increasing.

It has been practiced to form the outermost layer of a thermosensitive recording medium by cast coating method in order to increase the gloss of the surface of the thermosensitive recording medium (Reference 1, etc.). However, when improving the smoothness of the outermost layer of the thermosensitive recording medium in order to increase the gloss of its surface, the thermosensitive material in the thermosensitive recording medium melts to stick to the thermal head when printing, which deteriorates the printing run-ability. This is called as stick problem. To solve this problem, it has been practiced to contain a slipping agent, such as zinc laurate, in the outermost layer of the thermosensitive recording medium (Reference 2, etc.). It is also practiced to form a gloss layer as the outermost layer containing a slipping agent and a polysiloxane-grafted acrylic resin to improve the gloss and the anti-sticking property (Reference 3, etc.).

Meanwhile, it is known to contain a carboxyl group-containing resin in the outermost layer of the thermosensitive recording medium to improve water resistance etc. (Reference 4, etc.).

Reference 1: Japanese Patent Application Public Disclosure H10-217609

Reference 2: Japanese Patent Application Public Disclosure 2010-214728

Reference 3: Japanese Patent Application Public Disclosure H5-246140

Reference 4: International Publication WO2011/145545

Problems to be Solved by the Invention

The present inventors have found that the printing run-ability at high-speed printing is deteriorated when the outermost layer contains a slipping agent and a silicone copolymer, although the gloss and the anti-sticking property are improved (see Comparative Examples 6-8). Note that the high speed printing refers to printing at printing speed of 125 mm/sec or higher (corresponding to 5 inch/sec or higher) in the present application, while the normal printing speed is about 50-75 mm/sec (corresponding to 2-3 inch/sec).

To obtain the same level of the color developing sensitivity at high-speed printing as that of the normal printing, it is necessary to keep the cumulative energy applied from a thermal head to the thermosensitive recording medium at high-speed printing as the same level as that of the normal printing. To attain this, it is necessary to increase the intensity of the energy (i.e. peak intensity, that is the maximum of the applied energy) applied from a thermal head to the thermosensitive recording medium at high-speed printing, because the time for applying energy from the thermal head to the thermosensitive recording medium becomes shorter at high-speed printing than at normal-speed printing. However, increasing the strength of the energy makes the slipping agent and the binder softened and melted easily to produce the above-described stick problem significantly.

Therefore, by inclusion of a slipping agent and/or silicone copolymer in the outermost layer of the thermosensitive recording medium as in the references, the stick problem may occur at high-speed printing, or the printing may not be performed properly because an empty run occurs and papers are feed incorrectly.

And, by inclusion of solid slipping agents solid, such as zinc stearate, which is commonly used as a slipping agent, in the outermost layer of the thermosensitive recording medium, the gloss of the surface may be lowered, the unevenness of the surface gloss may occur, and/or the heat transmission becomes unbalanced to occur the print unevenness, due to the surface roughness caused by the inclusion of the solid slipping agent.

Then the purpose of the present invention is to provide a thermosensitive recording medium with an increased gloss in the blank and printed portions, excellent color developing sensitivity and excellent printing run-ability (mainly anti-stick property), particularly excellent printing run-ability at high-speed printing.

Means to Solve the Problems

As a result of intensive studies, the inventors have discovered that the problem described above can be resolved by preparing a thermosensitive recording layer, an intermediate layer containing a carboxyl group-containing resin, and a gloss layer as an outermost layer in this order on a substrate, wherein the gloss layer contains a long chain alkyl group-containing resin and an emulsion type silicone copolymer resin.

That is, the present invention is a thermosensitive recording medium having a thermosensitive recording layer comprising a colorless or pale colored basic leuco dye and an electron accepting color developing agent, an intermediate layer and a gloss layer as an outermost layer in this order on a substrate, wherein the intermediate layer is formed by containing a carboxyl group-containing resin and the gloss layer is formed by containing a long chain alkyl group-containing resin and an emulsion type silicone copolymer resin.

Advantages of the Invention

The thermosensitive recording medium of the present invention has an increased gloss in the blank and printed portions, excellent color developing sensitivity and excellent printing run-ability (mainly anti-stick property), particularly excellent printing run-ability at high-speed printing.

DETAILED DESCRIPTION OF THE INVENTION

Thermosensitive recording medium of the present invention has a thermosensitive recording layer, an intermediate layer and a gloss layer as an outermost layer in this order on a substrate.

The material used as the substrate of the thermosensitive recording medium of the present invention is not particularly limited and materials, such as paper, recycled paper, synthetic paper, film, resin coat paper and the like, can be used.

The gloss layer of the present invention is formed by containing a long chain alkyl group-containing resin and an emulsion type silicone copolymer resin. It is preferred that the gloss layer does not contain a long chain alkyl group-containing resin other than an acrylic resin containing long-chain alkyl group(s) and an acrylic acid ester copolymer resin containing long-chain alkyl group(s). The long chain alkyl group-containing resin that is preferably not contained in the gloss layer of the present invention includes those generally used as a slipping agent. The gloss layer, if necessary, may contain a pigment, a binder, a crosslinking agent etc.

The long chain alkyl group-containing resin used in the present invention includes, acrylic resin containing long-chain alkyl group(s), such as acrylic acid ester copolymer resin containing long-chain alkyl group(s), acryl amide copolymer resin containing long-chain alkyl group(s) and the like, copolymer resins of an alkylated polymer and a long chain alkyl compound, such as vinyl ester copolymer resin containing long-chain alkyl group(s), allyl ester copolymer resin containing long-chain alkyl group(s), stearyl isocyanate-modified products of polyvinyl alcohol and the like, preferably acrylic resin containing long-chain alkyl group(s), more preferably acrylic acid ester copolymer resin containing long-chain alkyl group(s). These may be used individually and also in mixtures of at least two of them.

The number of carbon atoms of the long-chain alkyl group(s) is preferably from 6 to 30, more preferably from 8 to 28. When the number of carbon atoms is less than 6, a sufficient printing run-ability (mainly anti-stick property) may not be obtained.

As a specific examples of the long chain alkyl group-containing resin used in the present invention, Rezem P-677, Rezem S-310, Rezem K-256 (Chukyo Yushi Co., Ltd.), Piroyl 1010, Piroyl 406 (Lion Specialty Chemicals Co., Ltd.) and the like may be cited.

The film forming temperature of the long chain alkyl group-containing resin used in the present invention is preferably less than the color developing temperature of the thermosensitive recording layer, particular less than 100 degree C., because the so-called background color development is not likely to occur.

As a specific example, Rezem P-677 (film forming temperature: 80-90 degree C.), Rezem S-310 (film forming temperature: 70-80 degree C.) and the like may be preferably used.

The emulsion type silicone copolymer resin used in the present invention is that obtained by copolymerizing a silicone compound and an organic resin other than silicone compound, which is then emulsified. As this organic resin, alkyd resin, acrylic resin, urethane resin, polyol resin, epoxy resin, urea resin, polyester resin, and melamine resin and the like may be cited. In the present invention, silicone-acryl copolymer resin wherein the organic resin is acrylic resin, and silicone-urethane copolymer resin wherein the organic resin is urethane resin are preferable. These may be used individually and also in mixtures of at least two of them.

As a specific examples of the emulsion type silicone copolymer resin used in the present invention, Shaline R170EM (silicone-acrylic copolymer resin: graft copolymer of polyalkylsiloxane and methacrylic acid alkyl esters/methacrylic hydroxyalkyl esters copolymer), Shaline FE230N (Nissin Chemical Industry Co., Ltd.), Symac US-450, Symac US-480 (silicone-acryl graft copolymer resin) (Toagosei Co., Ltd.), Daiallomer SPW (silicone-fluorine copolymer resin) Resamine D-6040SP (silicone-polyurethane copolymer resin) (Dainichiseika Color & Chemicals Mfg. Co., Ltd.) and the like may be cited.

The amounts (hereinafter, weight is on a solid basis) of the long chain alkyl group-containing resin and the emulsion-type silicone copolymer resin in the gloss layer are preferably from 80 to 100 parts by weight per 100 parts by weight of the total solid content of the gloss layer. In addition, the amount of the emulsion-type silicone copolymer resin in the total amount of the long chain alkyl group-containing resin and the emulsion type silicone copolymer resin is preferably from 10 to 40% by weight.

By using the above range of the amount of the long chain alkyl group-containing resin and the emulsion-type silicone copolymer resin in the gloss layer, sufficient gloss of the recorded surface, especially sufficient gloss in the printed portions can be obtained, and printing run-ability (mainly anti-stick property), particularly printing run-ability at high-speed printing can become excellent.

When the amount of the emulsion type silicone copolymer resin is higher than the above range, the friction coefficient, particularly the static friction coefficient, of the gloss layer decreases largely and problems occur, such as decrease in the yield of manufacturing thermosensitive recording medium, reduction in the operability, and empty running when using.

These problems occurs significantly when the static friction coefficient of the gloss layer (i.e. the static friction coefficient between the surface of the gloss layer and the surface opposite to the gloss layer of the thermosensitive recording medium) is less than 0.20. Then the amount of the emulsion type silicone copolymer resin is preferably adjusted so that the static friction coefficient of the gloss layer is 0.20 or higher.

In the present invention, as the glossiness of the blank portion of the thermosensitive recording medium (i.e. the glossiness of the recording surface), the gloss measured at 75 degree according to JIS-P8142 is preferably 30% or higher in order to produce a sense of luxury.

Also, when the glossiness of the recording surface is such that the gloss at 75 degree is preferably 30% or higher, more preferably 40% or higher, to obtain a recorded image with fine definition.

In the present invention, although the coating amount of the gloss layer is not particularly limited, the coating amount is preferably 0.1-4.0 g/m$^2$ in terms of solid content.

The intermediate layer of the present invention contains a carboxyl group-containing resin. The intermediate layer may further contain a pigment and/or a binder other than a carboxyl group-containing resin.

As described above, the intensity of the energy applied from a thermal head to the thermosensitive recording medium (particularly peak intensity, that is the maximum of the applied energy) needs to be higher at high-speed printing, which makes the slipping agent and the binder softened and melted easily to produce the stick problem significantly. However, it is considered that the inclusion of a carboxyl group-containing resin in the intermediate layer makes heat resistance better due to the strong binding strength of the carboxyl group-containing resin, which prevents the occurrence of the stick problem to bring a good printing runability at high-speed printing.

Furthermore, since the adhesion between the gloss layer and the intermediate layer becomes better due to the carboxyl group-containing resin contained in the intermediate layer, the abnormal occurrence such as the separation between the intermediate layer and the gloss layer and the fracture within the layer of the intermediate layer can be prevented, even when a strong shear is applied on the thermosensitive recording medium at high speed printing, then the water resistance, especially the water-blocking property, etc. becomes better.

As the examples of the carboxyl group-containing resin used in the present invention, an acrylic resin, oxidized starch, carboxymethyl cellulose, carboxy-modified polyvinyl alcohol obtained by introducing carboxyl groups into polyvinyl alcohol, may be cited, and an acrylic resin and a carboxy-modified polyvinyl alcohol are particularly preferred.

The acrylic resin used in the present invention contains (meth)acrylic acid and a monomer that can be copolymerized with (meth)acrylic acid. The amount of (meth)acrylic acid in the acrylic resin is preferably from 1 to 10 parts by weight per 100 parts by weight of acrylic resin. The (meth) acrylic acid is soluble in alkali and has a characteristic activity of converting an acrylic resin to a water soluble resin by adding a neutralizer. By converting an acrylic resin to a water soluble resin, the affinity to pigments becomes improved, when a intermediate layer contains pigments, which makes the intermediate layer have a superior strength even in the presence of large amount of pigments. The monomer element that can be copolymerized with (meth) acrylic acid includes, for example, alkyl acrylic acid resin, such as methyl(meth)acrylate, ethyl(meth)acrylate, propyl (meth)acrylate, iso-butyl(meth)acrylate, pentyl (meth)acrylate, hexyl (meth)acrylate, 2-ethyl hexyl (meth)acrylate, octyl (meth)acrylate and the like, modified alkyl acrylic acid resin, such as alkyl acrylic acid resin as above that is modified with epoxy resin, silicone resin, styrene or these derivatives, (meth)acrylonitrile, acrylic ester and hydroxyalkyl acrylic ester. Among these, (meth)acrylonitrile and/or methyl (meth)acrylate are preferred. The amount of (meth) acrylonitrile in the acrylic resin is preferably from 15 to 70 parts by weight per 100 parts by weight of acrylic resin and the amount of methyl (meth)acrylate in the acrylic resin is preferably from 20 to 80 parts by weight per 100 parts by weight of acrylic resin.

The glass transition temperature (Tg) of the acrylic resin contained in the intermediate layer is preferably higher than 30 degree C., more preferably higher than 30 degree C. and lower than or equal to 130 degree C., further preferably higher than 50 degree C. and lower than or equal to 95 degree C. When the Tg is lower than 30 degree C., sufficient heat resistance may not be attained, although water resistance is sufficient. On the contrary, when the Tg of the acrylic resin is higher than 130 degree C., the intermediate layer becomes brittle and water resistance, plasticizer resistance and solvent resistance etc. may not be sufficient, and the purpose of the present invention cannot be attained. The Tg of acrylic resin is measured by differential scanning calorimetry (DSC).

The acrylic resin that can be used in the intermediate layer of the present invention is preferably a non-core-shell type acrylic resin. In general, a core-shell type acrylic resin is superior to a non-core-shell type acrylic resin in thermal resistance. However, a core-shell type acrylic resin also have a disadvantage, that is, color developing sensitivity is inferior because of lower thermal-conductivity. The non-core-shell type acrylic resin used in the present invention with Tg of higher than 30 degree C. and lower than or equal to 130 degree C. is superior in heat resistance and has an advantage that color developing sensitivity is superior.

The carboxy-modified polyvinyl alcohol used in the present invention may be obtained in the form of a reaction product of polyvinyl alcohol and a polyvalent carboxylic acid, such as fumaric acid, phthalic anhydride, mellitic anhydride, itaconic anhydride and the like, or esterified materials of these reaction products or, furthermore, in the form of saponified materials of the copolymers of vinyl acetate with an ethylenic unsaturated dicarboxylic acid, such as maleic acid, fumaric acid, itaconic acid, crotonic acid, acrylic acid, methacrylic acid and the like. More specifically, for example, the products prepared in Example 1 or Example 4 of Japanese Patent Application Public Disclosure S53-91995 may be cited. In addition, a degree of saponification of from 72 to 100 mole % is preferred for the carboxy-modified polyvinyl alcohol. A degree of polymerization of the carboxy-modified polyvinyl alcohol is preferably from 500 to 2400, more preferably 1000 to 2000.

The intermediate layer of the present invention preferably comprises an epichlorohydrin resin and a modified polyamine/amide resin (except epichlorohydrin resin, similar hereinafter) in addition to a carboxy-modified polyvinyl alcohol.

As specific examples of the epichlorohydrin resins that can be used in the present invention, poly(amide epichlorohydrin) resins, poly(amine epichlorohydrin) resins and the like may be cited and they can be used individually or in combinations. In addition, primary to quaternary amines may be used as the amine that is present in the main chain of an epichlorohydrin resin, and no particular restrictions apply. Furthermore, a degree of cationization of no greater than 5 meq/g·solid (measured at pH 7) and a molecular weight of at least 500,000 are preferred for the degree of cationization and the molecular weight based on good water resistance. Sumirez Resin 650 (30), Sumirez Resin 675A, Sumirez Resin 6615 (the above, Sumitomo Kagaku K.K.), WS4002, WS 4020, WS4024, WS4030, WS4046, WS4010, CP8970 (the above, Seiko PMC K.K.) may be cited as specific examples.

The polyamine/amide resin that can be used in the present invention includes polyamide urea resins, polyalkylene polyamine resins, polyalkylene polyamide resins, polyamine polyurea resins, modified polyamine resins, modified polyamide resins, polyalkylene polyamine urea formalin resins, and polyalkylene polyamine polyamide polyurea resins. Specific examples include Sumirez resin 302 (polyamine polyurea resin produced by Sumitomo Chemical Co., Ltd.), Sumirez resin 712 (polyamine polyurea resin produced by Sumitomo Chemical Co., Ltd.), Sumirez resin 703 (polyamine polyurea resin produced by Sumitomo Chemical Co., Ltd.), Sumirez resin 636 (polyamine polyurea resin produced by Sumitomo Chemical Co., Ltd.), Sumirez resin SPI-100 (modified polyamine resin produced by Sumitomo Chemical Co., Ltd.), Sumirez resin SPI-102A (modified polyamine resin produced by Sumitomo Chemical Co., Ltd.), Sumirez resin SPI-106N (modified polyamide resin produced by Sumitomo Chemical Co., Ltd.), Sumirez resin SPI-203(50)(Sumitomo Chemical Co., Ltd.), Sumirez resin SPI 198 (Sumitomo Chemical Co., Ltd.), PrintiveA-700 (Asahi Kasei Corporation), PrintiveA-600 (Asahi Kasei Corporation), PA6500, PA6504, PA6634, PA6638, PA6640, PA6644, PS6646, PA6654, PA6702, PA 6704 (the above, polyalkylene polyamine polyamide polyurea resins produced by Seiko PMC) without any restriction, and they can be used solely or in combinations of two kinds or more. From the viewpoint of recording sensitivity, polyamine resins (polyalkylene polyamine resins, polyamine polyurea resins, modified polyamine resins, polyalkylene polyamine urea formalin resins, and polyalkylene polyamine polyamide polyurea resins) are preferable.

In the present invention, although the amount of the carboxyl group-containing resin contained in the intermediate layer of the present invention is not particularly limited, the amount is preferably 1 weight parts or more, more preferably from 10 to 60 weight parts, per 100 weight parts of the total intermediate layer in terms of solid content from the viewpoint of water resistance. When the amount is less than 1 weight parts, the membrane cannot be formed sufficiently and accordingly the advantages of installing the intermediate layer cannot be obtained.

The amount of either the epichlorohydrin resin and the modified polyamine/amide resin is preferably from 1 to 100 weight parts, more preferably from 5 to 50 weight parts per 100 weight parts of the carboxy-modified polyvinyl alcohol. By using one part by weight or more, preferably 5 parts by weight or more, of either of these resins, the glossiness of the blank portion and recorded portion are superior. And by using 100 parts by weight or less, preferably 50 parts by weight or less, of either of these resins, increased coating solution viscosity and gel formation are difficult to take place and these do not cause operational problems.

The intermediate layer of the present invention preferably further contains pigment. The aspect ratio of the pigment is preferably more than or equal to 30. By adding such a pigment to the intermediate layer, small unevenness is imparted to the surface of the gloss layer, while maintaining the homogeneity of the gloss layer. This unevenness does not lower the glossiness of the surface of the gloss layer, since this unevenness is much smaller than the unevenness caused by incorporating a (solid) slipping agent into the gloss layer.

Moreover, since this unevenness creates an appropriate space between the thermal head or the like and the gloss layer, the thermal head or the like never be close contact with the gloss layer. Therefore, superior printing run-ability (mainly anti-stick property) can be achieved.

As the pigment used in the intermediate layer of the present invention, inorganic or organic fillers and the like such as kaolin, calcined kaolin, aluminum hydroxide, silica, calcium carbonate, diatomaceous earth, talc, titanium oxide, and the like may be cited. As the pigment used in the intermediate layer, kaolin, calcined kaolin and aluminum hydroxide are preferred by considering the abrasion of the thermal head. Especially, kaolin with an aspect ratio of more than or equal to 30, preferably 30-100, more preferably 30-85, is preferable, since a thermosensitive recording medium with superior quality can be prepared.

The aspect ratio of pigments is obtained by taking a photograph of the pigment powder, measuring diameter and thickness for randomly chosen 100 powder particles, and calculating the ratio of diameter/thickness to average these ratios. As the aspect ratio is lager, the flatness of pigment is larger.

The oil absorbance of kaolin with an aspect ratio of more than or equal to 30 that can be used in the intermediate layer of present invention is usually from 50 to 80 ml/100 g, and its BET specific surface is usually from 10 to 30 $m^2/g$.

By using kaolin with an aspect ratio of more than or equal to 30 in the intermediate layer of present invention, the glossiness of the blank portion and recorded portion and the printing run-ability (mainly anti-stick property) are superior, since the homogeneity of the unevenness imparted on the surface of the gloss layer is high.

The coating amount for an intermediate layer is not particularly limited and is ordinarily in the range of from 0.5 $g/m^2$ to 5.0 $g/m^2$ in terms of dry weight.

The various materials used in the thermosensitive recording layer of the thermosensitive recording medium of the present invention are shown below. However, a binder, a cross linking agent, a pigment etc. can be used also for other coating layer(s), such as the gloss layer, the intermediate layer etc., in the range which does not inhibit the desired effect for the problems described above.

All of the color developing agents well known in the conventional field of pressure sensitive and thermosensitive recording media may be used as the color developing agent in a thermosensitive recording material of the present invention. Although the color developing agent is not particularly restricted, activated clay, attapulgite, colloidal silica, inorganic acidic substances such as aluminum silicate and the like, 4,4'-isopropylidene diphenol, 1,1-bis(4-hydroxyphenyl) cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl) sulfone, 4-hydroxy-4'-methyl diphenyl sulfone, 4-hydroxyphenyl-4'-benzyloxyphenyl sulfone, 3,4-dihydroxyphenyl-4-methyl phenyl sulfone, 1-[4-(4-hydroxyphenyl-sulfonyl) phenoxy]-4-[4-(4-isopropoxyphenyl sulfonyl) phenoxy]butane, phenol condensate composition described in Japanese Patent Application Public Disclosure No. 2003-154760, aminobenzene sulfonamide derivatives described in Japanese Patent Application Public Disclosure No. H08-59603, bis(4-hydroxyphenyl thioethoxy) methane, 1,5-di(4-hydroxyphenyl thio)-3-oxapentane, butyl bis(p-hydroxyphenyl) acetate, methyl bis(p-hydroxyphenyl) acetate, 1,1-bis (4-hydroxyphenyl)-1-phenyl ethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl) sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino]salicylate dihydrate, 4-[2-(p-methoxyphenoxy) ethyloxy]salicylic acid, 4-[3-(p-trisulfonyl) propyloxy]salicylic acid, aromatic carboxylic acids such as 5-[p-(2-p -methoxyphenoxyethoxy) cumyl]salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited.

These color developing agents may be used individually and in mixtures of at least two.

1-[4-(4-hydroxyphenyl-sulfonyl) phenoxy]-4-[4-(4-isopropoxyphenyl sulfonyl) phenoxy]butane is available under the trade name of JKY-214 produced by API Corporation. The phenol condensate composition described in Japanese Patent Application Public Disclosure No. 2003-154760 is available under the trade name of JKY-224 produced by API Corporation. The diphenylsulfone crosslinked type compound described in International Publication WO97/16420 is available under the trade name of D-90 produced by Nippon Soda Co., Ltd. The compound described in International Publication WO02/081229 is also available under the trade names of NKK-395 and D-100 produced by Japan Soda K.K. In addition, high molecular weight aliphatic acid metal complex salts described in Japanese Patent Application Public Disclosure No. H10-258577 and metal chelate type color development components such as polyvalent hydroxy aromatic compounds and the like may also be present.

All of the dyes well known in the conventional field of pressure sensitive and thermosensitive recording media may be used as the electron donating leuco dye in the present invention. Although the dye is not particularly restricted, triphenylmethane type compounds, fluorane type compounds, fluorene type compounds, divinyl type compounds and the like are preferred. Specific examples of the typical colorless to pale colored basic colorless dye (dye precursors) are shown below. In addition, these dye precursors may be used individually and also in mixtures of at least two of them.

<Triphenylmethane Type Leuco Dyes>

3,3-bis(p-Dimethyl aminophenyl)-6-dimethylaminophthalide [alternate name: crystal violet lactone] and 3,3-bis(p-Dimethyl aminophenyl) phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethyl amino-6-methyl-7-(p-chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octyl anilino fluorane, 3-diethyl amino-6-methyl-7-n-octylamino fluorane, 3-diethylamino-6-methyl-7-benzylamino fluorane, 3-diethyl amino-6-methyl-7-dibenzylamino fluorane, 3-diethylamino-6-chloro-7-methyl fluorane, 3-diethylamino-6-chloro-7-anilino fluorane, 3-diethylamino-6-chloro-7-p -methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethyl amino-7-(o-chloroanilino) fluorane, 3-diethylamino-7-(p-chloroanilino) fluorane, 3-diethyl amino-7-(o-fluoroanilino) fluorane, 3-diethylamino-benz[a]fluorane, 3-diethylamino-benz[c]fluorane, 3-dibutylamino-6-methyl-fluorane, 3-dibutylamino-6-methyl-7-anilino fluorane, 3-dibutylamino-6-methyl-7-(o,p-dimethylanilino) fluorane, 3-dibutylamino-7-(o-chloroanilino) fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino) fluorane, 3-dibutyl amino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p -methyl anilino fluorane, 3-dibutylamino-7-(o-chloroanilino) fluorane, 3-dibutyl amino-7-(o-fluoroanilino) fluorane, 3-di-n-pentylamino-6-methyl-7-anilino fluorane, 3-di-n-pentyl amino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-iso amyl amino)-6-chloro-7-anilino fluorane, 3-(N-ethyl-N-tetrahydrofurfurylamino)-6-methyl-7-anilino fluorane, 3-(N-ethyl-N-isobutyl amino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-o-(p-dimethylaminophenyl) aminoanilino fluorane, 2-methoxy-6-p-(p-dimethylaminophenyl) aminoanilino fluorane, 2-chloro-3-methyl-6-p-(p-phenylaminophenyl) aminoanilino fluorane, 2-chloro-6-p-(p-dimethylaminophenyl) aminoanilino fluorane, 2-nitro-6-p-(p-diethylaminophenyl) aminoanilino fluorane, 2-amino-6-p -(p-diethylaminophenyl) aminoanilino fluorane, 2-diethylamino-6-p -(p-diethylaminophenyl) aminoanilino fluorane, 2-phenyl-6-methyl-6-p-(p-phenylaminophenyl) aminoanilino fluorane, 2-benzyl-6-p-(p-phenyl aminophenyl) aminoanilino fluorane, 2-hydroxy-6-p-(p-phenylaminophenyl) aminoanilino fluorane, 3-methyl-6-p-(p-dimethylaminophenyl) aminoanilino fluorane, 3-diethylamino-6-p-(p-diethylaminophenyl) aminoanilino fluorane, 3-diethylamino-6-p-(p-dibutylaminophenyl) aminoanilino fluorane and 2,4-dimethyl-6-[(4-dimethylamino) anilino]fluorane.

<Fluorene Type Leuco Dye>

3,6,6-Tris(dimethylamino) spiro[fluorane-9,3'-phthalide] and 3,6,6'-tris(diethylamino) spiro[fluorane-9,3'-phthalide].

<Divinyl Type Leuco Dyes>

3,3-bis-[2-(p-Dimethylaminophenyl)-2-(p-methoxyphenyl) ethenyl]-4,5,6,7-tetrabromophthalide, 3,3-bis-[1,1-bis (4-pyrolidinophenyl) ethylene-2-yl]-4,5,6,7-etrabromophthalide <Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexylethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitroanilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2, 2-dinitrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

The previously well known sensitizers may be used as the sensitizer in the thermosensitive recording medium of the present invention. As such sensitizers, aliphatic acid amides such as stearic acid amide, palmitic acid amide and the like, ethylene bis-amide, montan acid wax, polyethylene wax, 1,2-di-(3-methylphenoxy) ethane, p-benzyl biphenyl, β-benzyloxy naphthalene, 4-biphenyl-p-tolyl ether, m-terphenyl, 1,2-diphenoxyethane, dibenzyl oxalate, di(p-chlorobenzyl) oxalate, di(p-methylbenzyl) oxalate, dibenzyl terephthalate, benzyl p-benzyloxy benzoate, di-p-tolyl carbonate, phenyl-α-naphthyl carbonate, 1,4-diethoxynaphthalene, 1-hydroxy-2-naphthoic acid phenyl ester, o-xylene-bis-(phenyl ether), 4-(m-methyl phenoxymethyl) biphenyl, 4,4'-ethylene dioxy-bis-benzoic acid dibenzyl ester, dibenzoyloxy methane, 1,2-di(3-methylphenoxy) ethylene, bis[2-(4-methoxy-phenoxy) ethyl]ether, methyl p-nitrobenzoate, phenyl p-toluene sulfonate, o-toluenesulfonamide, p-toluenesulfonamide, and the like may be listed as examples. These sensitizers may be used individually and as mixtures of at least two of them.

As a pigment, kaolin, calcined kaolin, calcium carbonate, aluminum oxide, titanium oxide, magnesium carbonate, aluminum silicate, magnesium silicate, calcium silicate, aluminum hydroxide, silica and the like may be used. These pigments may be used in combinations depending on the required quality.

As the binder used in the present invention, polyvinyl alcohols such as completely saponified polyvinyl alcohol, partially saponified polyvinyl alcohol, acetoacetylated polyvinyl alcohol, carboxyl-modified polyvinyl alcohol, amide-modified polyvinyl alcohol, sulfonic acid-modified polyvinyl alcohol, butyral-modified polyvinyl alcohol, olefin-modified polyvinyl alcohol, nitrile-modified polyvinyl alcohol, pyrolidone-modified polyvinyl alcohol, silicone-modified polyvinyl alcohol, silanol-modified polyvinyl alcohol, cation-modified polyvinyl alcohol, terminal alkyl-modified polyvinyl alcohol and the like; starch such as enzyme modified starch, thermochemically modified starch, oxidized starch, esterified starch, etherified starch (for example, such as hydroxyethyl starch), cationic starch and the like; cellulose ethers and derivatives thereof such as hydroxyethyl cellulose, methyl cellulose, ethyl cellulose, carboxymethyl cellulose, acetyl cellulose and the like; polyacrylamides such as polyacrylamide, cationic polyacrylamides, anionic polyacrylamides, amphoteric polyacrylamides and the like; urethane resins such as polyester polyurethane resins, polyether polyurethane resins, polyurethane-based ionomer resin and the like; styrene-butadiene resins such as styrene-butadiene copolymer, styrene-butadiene-acrylonitrile copolymer, styrene-butadiene-acrylic copolymer and the like; butadiene-acrylonitrile copolymer; polyamide resins; unsaturated polyester resins; polyvinyl acetate; polyvinyl chloride; polyvinylidene chloride; polyacrylic ester resin; casein; gelatin; gum arabic, polyvinyl butylal, polystyrol and their copolymers; silicone resins; petroleum resins; terpene resins; ketone resins; cumaron resins and the like may be listed as examples.

The polymeric substances may be used upon dissolving them in a solvent such as water, alcohol, ketones, esters, hydrocarbons and the like or upon emulsifying or dispersing into a paste in water or other media. The polymeric materials may also be used in combinations according to the qualities demanded.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borate sand, boric acid, alum, ammonium chloride and the like may be listed as examples.

As the slipping agent used in the present invention, waxes, silicones resins, metal salts of higher fatty acid such as zinc stearate, calcium stearate, zinc laurate and the like, higher fatty acid ester, phosphoric ester or alkali metal salt thereof, sulfonic acid ester or alkali metal salts thereof, glycerin fatty acid ester and the like may be cited.

In addition, a stabilizing agent that instills oil resistance in recorded images such as 4,4'-butylidene (6-t-butyl-3-methylphenol), 2,2'-di-t-butyl-5,5'-dimethyl-4,4'-sulfonyl diphenol, 1,1,3-tris (2-methyl-4-hydroxy-5-cyclohexylphenyl) butane, 1,1,3-tris (2-methyl-4-hydroxy-5-t-butylphenyl) butane and the like may also be added in the range that does not adversely affect the desired effects for the problems described above.

In addition, a benzophenone type and triazole type UV light absorption agent, dispersion agent, de-foaming agent, antioxidant, fluorescent dye and the like may also be used.

The types and amounts of the leuco dye, color developing agent, sensitizer and other various ingredients used in the thermosensitive recording medium of the present invention are determined according to the required performance and printability and are not particularly restricted. However, from 0.5 parts to 10 parts of the color developing agent, from 0.5 parts to 20 parts of the pigment, from 0.5 parts to 10 parts of the sensitizer, from 0.01 parts to 10 parts of the stabilizing agent and from 0.01 parts to 10 parts of the other ingredients are ordinarily used per 1 part of the leuco dye.

The leuco dye, the color developing agent and materials added when needed are finely ground into particles, several microns or smaller in size, using a grinder or a suitable emulsification device such as a ball mill, attritor, sand grinder and the like, and a coating solution is prepared by adding a binder and various additive materials depending on the objective. Water, alcohol and the like can be used as the solvent for the coating solution and the solid content of the coating solution is about from 20 to 40 wt. %.

In the thermosensitive recording medium of the present invention, an undercoat layer may be installed between the thermosensitive recording layer and the substrate.

The undercoat layer comprises mainly a binder and a pigment.

As the binder for the undercoat layer, the binder as described for the above thermosensitive recording layer may be used. These binders may be used individually or in combinations of at least two.

As the pigment for the undercoat layer, the pigment as described for the above thermosensitive recording layer may be used. These pigments may be used individually or in combinations of at least two.

The pigment in the undercoat layer is ordinarily from 50 wt. % to 95 wt. %, preferably from 70 wt. % to 90 wt. % per total solid fraction.

Various aids such as a dispersion agent, plasticizer, pH controlling agent, de-foaming agent, water retention agent, preservative, coloring dye, UV light inhibiting agent and the like may also be appropriately added to the coating solution for the undercoat layer.

In the present invention, the method for coating the thermosensitive recording layer, the intermediate layer, the gloss layer and the other coating layer is not limited in particular, but any well-known conventional techniques may be used. The method for coating may be appropriately selected and used among, for example, off-machine coater and on-machine coater, which is equipped with coaters such as air knife coater, rod blade coater, bent blade coater, bevel blade coater, roll coater, curtain coater.

The coating amount of the thermosensitive recording layer is not limited in particular, but the typical dried coating amount of the thermosensitive recording layer is ordinarily in the range of from 2 to 12 g/m$^2$.

Furthermore, various technologies known in the thermosensitive recording medium field may be used as needed, for example, a flattening treatment such as super calendaring and the like can be conducted after coating individual coating layers.

EXAMPLES

The following Examples illustrate the present invention, but the Examples are not intended to limit the scope of the present invention. In the following description, the terms parts and % indicate parts by weight and wt. %, respectively. The coatings and dispersions were prepared as described below.

Example 1

Undercoating Layer Coating Solution

Undercoating layer coating solution was prepared by dispersing and stirring the following formulation:

| | |
|---|---|
| Calcined kaolin (BASF Co., Ansilex 90) | 100.0 parts |
| Styrene-butadiene copolymer latex (Zeon Corporation, ST5526, solid content: 48%) | 20.0 parts |
| Water | 50.0 parts |

This undercoat layer coating solution was applied on one side of a groundwood free paper with a basis weight 47 g/m$^2$ by using a bent blade coater with a coating amount (in solid) of 10.0 g/m$^2$, and was dried to prepare an undercoated paper.

First color developing agent dispersion (solution A1), second color developing agent dispersion (solution A2), a dye dispersion (solution B) and a sensitizer dispersion (solution C) with the following formulation were separately wet ground using sand grinders until the average particle size was about 0.5 μm.

First Color Developing Agent Dispersion (Solution A1)

| | |
|---|---|
| 2,4'-dihydroxydiphenyl sulfone (Nicca Chemical Co., Ltd., BPS-24C) | 6.0 parts |
| Aqueous solution of completely saponified polyvinyl alcohol (Kuraray Co., Ltd., PVA117, solid content: 10%) | 5.0 parts |
| Water | 1.5 parts |

Second Color Developing Agent Dispersion (Solution A2)

| | |
|---|---|
| Diphenylsulfone crosslinked type compound (Nippon Soda Co., Ltd., D-90) | 6.0 parts |
| Aqueous solution of completely saponified polyvinyl alcohol (Kuraray Co., Ltd., PVA117, solid content: 10%) | 5.0 parts |
| Water | 1.5 parts |

Leuco Dye Dispersion (Solution B)

| | |
|---|---|
| 3-Dibutylamino-6-methyl-7-anilinofluorane (Yamamoto Chemicals Inc., ODB-2) | 6.0 parts |
| Aqueous solution of completely saponified polyvinyl alcohol (Kuraray Co., Ltd., PVA117, solid content: 10%) | 5.0 parts |
| Water | 1.5 parts |

Sensitizer Dispersion (Solution C)

| | |
|---|---|
| Diphenyl sulfone (UCB Japan Co. Ltd., DPS) | 6.0 parts |
| Aqueous solution of completely saponified polyvinyl alcohol (Kuraray Co., Ltd. PVA117, solid content: 10%) | 5.0 parts |
| Water | 1.5 parts |

Next these dispersions were blended in the proportion described below to prepare the thermosensitive recording layer coating solution 1.

Thermosensitive Recording Layer Coating Solution 1

| | |
|---|---|
| First color development agent dispersion (Solution A1) | 18.0 parts |
| Second color development agent dispersion (Solution A1) | 18.0 parts |
| Leuco dye dispersion (Solution B) | 18.0 parts |
| Sensitizer dispersion (Solution C) | 36.0 parts |
| Silica dispersion (Mizusawa Industrial Chemicals, Ltd., Mizukasil P-537, solid content: 25%) | 17.5 parts |
| Aqueous solution of completely saponified polyvinyl alcohol (Kuraray Co., Ltd., PVA117, solid content: 10%) | 25.0 parts |

This thermosensitive recording layer coating solution 1 was applied on the undercoat layer of the above undercoated paper by using a rod blade coater with a coating amount (in solid) of 6.0 g/m$^2$ and was dried to prepare a thermosensitive recording layer coated paper.

Next the following materials were mixed with the described proportions to prepare the intermediate layer coating solution 1.

Intermediate Layer Coating Solution 1

| | |
|---|---|
| 50% dispersion of Engineered kaolin (Imerys Co., Ltd., Contour 1500, aspect ratio: 60) | 4.0 parts |
| Non-core-shell type acrylic resin (Mitsui Chemicals, Inc., ASN1004K, Tg: 55 degree C., solid content: 18%) | 30.0 parts |
| Water | 1.5 parts |

This intermediate layer coating solution 1 was applied on the thermosensitive recording layer of the above thermosensitive recording layer coated paper by using a rod blade coater with a coating amount (in solid) of 1.5 g/m$^2$ and was dried to prepare an intermediate layer coated paper.

Next the following materials were mixed with the described proportions to prepare the gloss layer coating solution 1.

Gloss Layer Coating Solution 1

| | |
|---|---|
| Long chain alkyl group-containing resin (acrylonitrile-acrylic acid ester copolymer, Chukyo Yushi Co., Ltd., Rezem S-310, solid content: 37.5%) | 23.1 parts |
| Emulsion type silicone-acryl copolymer resin (graft copolymer of polyalkylsiloxane and methacrylic acid alkyl esters/methacrylic hydroxyalkyl esters copolymer, Nissin Chemical Industry Co., Ltd., Shaline R170EM, solid content: 45%) | 12.9 parts |

This gloss layer coating solution 1 was applied on the intermediate layer of the above intermediate layer coated paper by using a rod blade coater with a coating amount (in solid) of 2.0 g/m$^2$, dried and super calendared so that the smoothness was 5,000-10,000 seconds to yield a thermosensitive recording medium.

Example 2

A thermosensitive recording medium was prepared in the same manner described in Example 1 with the exception of changing the amount of the long chain alkyl group-containing resin in the gloss layer coating solution 1 from 23.1 parts to 31.4 parts and the amount of the emulsion type silicone-acryl copolymer resin in the gloss layer coating solution 1 from 12.9 parts to 4.6 parts.

Example 3

A thermosensitive recording medium was prepared in the same manner described in Example 1 with the exception of using 16.5 parts of emulsion type silicone-urethane copolymer resin (Silicone copolymer polycarbonate type polyurethane dispersion, Dainichiseika Color & Chemicals Mfg. Co., Ltd., Resamine D-6040SP, solid content: 35%) in place of 12.9 parts of the emulsion type silicone-acryl copolymer resin in the gloss layer coating solution 1.

Example 4

Next the following materials were mixed with the described proportions to prepare the intermediate layer coating solution 2.

Intermediate Layer Coating Solution 2

| | |
|---|---|
| 50% dispersion of Engineered kaolin (Imerys Co., Ltd., Contour 1500, aspect ratio: 60) | 4.0 parts |
| Carboxyl-modified polyvinyl alcohol (Kuraray Co., Ltd., KL118, solid content: 12%) | 26.7 parts |
| Polyamide epichlorohydrin (Seiko PMC, WS4030, solid content: 25%) | 3.8 parts |
| Modified polyamide resin (Sumitomo Chemical Co., Ltd., Sumirez Resin SPI-102, solid content: 45%) | 2.1 parts |
| Water | 10.0 parts |

This intermediate layer coating solution 2 was applied on the thermosensitive recording layer of the thermosensitive recording layer coated paper prepared in Example 1 by using a rod blade coater with a coating amount (in solid) of 1.5 g/m$^2$ and was dried to prepare an intermediate layer coated paper.

Then the gloss layer coating solution 1 was applied on the intermediate layer of the intermediate layer coated paper by using a rod blade coater with a coating amount (in solid) of 2.0 g/m$^2$, dried and super calendared so that the smoothness was 5,000-10,000 seconds to yield a thermosensitive recording medium.

Example 5

A thermosensitive recording medium was prepared in the same manner described in Example 4 with the exception of changing the amount of the long chain alkyl group-containing resin in the gloss layer coating solution 1 from 23.1 parts to 31.4 parts and the amount of the emulsion type silicone-acryl copolymer resin in the gloss layer coating solution 1 from 12.9 parts to 4.6 parts.

Example 6

A thermosensitive recording medium was prepared in the same manner described in Example 4 with the exception of using 16.5 parts of emulsion type silicone-urethane copolymer resin (Silicone copolymer polycarbonate type polyurethane dispersion, Dainichiseika Color & Chemicals Mfg. Co., Ltd., Resamine D-6040SP, solid content: 35%) in place of 12.9 parts of the emulsion type silicone-acryl copolymer resin in the gloss layer coating solution 1.

Comparative Example 1

A thermosensitive recording medium was prepared in the same manner described in Example 1 with the exception of changing the amount of the long chain alkyl group-containing resin in the gloss layer coating solution 1 from 23.1 parts to 0.0 parts.

Comparative Example 2

A thermosensitive recording medium was prepared in the same manner described in Example 1 with the exception of changing the amount of the emulsion type silicone-acryl copolymer resin in the gloss layer coating solution 1 from 12.9 parts to 0.0 parts.

Comparative Example 3

A thermosensitive recording medium was prepared in the same manner described in Example 1 with the exception of not installing the gloss layer.

Comparative Example 4

A thermosensitive recording medium was prepared in the same manner described in Example 4 with the exception of not installing the gloss layer.

Comparative Example 5

Next the following materials were mixed with the described proportions to prepare the intermediate layer coating solution 3.

Intermediate Layer Coating Solution 3

| | |
|---|---|
| 50% dispersion of Engineered kaolin (Imerys Co., Ltd., Contour 1500, aspect ratio: 60) | 4.0 parts |
| Aqueous solution of completely saponified polyvinyl alcohol (Kuraray Co., Ltd., PVA117, solid content: 10%) | 60.0 parts |

This intermediate layer coating solution 3 was applied on the thermosensitive recording layer of the thermosensitive recording layer coated paper prepared in Example 1 by using a rod blade coater with a coating amount (in solid) of 1.5 g/m$^2$ and was dried to prepare an intermediate layer coated paper.

Then the gloss layer coating solution 1 was applied on the intermediate layer of the intermediate layer coated paper by using a rod blade coater with a coating amount (in solid) of 2.0 g/m$^2$, dried and super calendared so that the smoothness was 5,000-10,000 seconds to yield a thermosensitive recording medium.

Comparative Example 6

A thermosensitive recording medium was prepared in the same manner described in Example 1 with the exception of using 8.7 parts of Zinc laurate (NOF Corporation, Zinc laurate GP, solid content: 100%) in place of 23.1 parts of the long chain alkyl group-containing resin in the gloss layer coating solution 1.

Comparative Example 7

A thermosensitive recording medium was prepared in the same manner described in Example 1 with the exception of using 5.5 parts of Sodium dialkylsuccinate sulfonate (Nippon Nyukazai Co., Ltd., NEWCOL291-PG, solid content: 70%) in place of 23.1 parts of the long chain alkyl group-containing resin in the gloss layer coating solution 1.

Comparative Example 8

A thermosensitive recording medium was prepared in the same manner described in Example 1 with the exception of using 3.9 parts of Polyglyceryl fatty acid ester (Riken Vitamin Co., Ltd., Poem J-0021, solid content: 100%) in place of 23.1 parts of the long chain alkyl group-containing resin in the gloss layer coating solution 1.

The thermosensitive recording media obtained were evaluated as described below.

<Color Development Sensitivity (Recorded Density)>

The prepared thermosensitive recording medium was printed a solid pattern (Relative brightness: 0, Printing speed: 50 mm/sec, Size: 10 cm×10 cm) by using a label printer (140XiIII manufactured by Zebra Co., Ltd.). The density of the recorded image was measured by using Macbeth Densitometer (RD-914, with Amber filter).

<Glossiness>

The glossiness of the blank portion (recording surface) of the prepared thermosensitive recording medium was measured at 75 degree according to JIS-P8142 by using a gloss meter (Nippon Denshoku Industries Co., Ltd., VG7000). And the glossiness of the surface printed the solid pattern (printed portion) in above measurement of Color development sensitivity was also measured at 75 degree. The quality is better as the glossiness is higher.

<Print Image Quality>

The prepared thermosensitive recording medium was printed a solid pattern (Relative brightness: −15, Printing speed: 50 mm/sec, Size: 10 cm×10 cm) by using a label printer (140XiIII manufactured by Zebra Co., Ltd.). Then the print image quality was visually evaluated on the following criteria. If the evaluation is rated as Excellent or Good, no problem was experienced in the practical use.

Excellent: No uneven glossiness, no uneven color development and no unrecorded area were observed and the solid pattern was printed evenly.

Good: Slight uneven glossiness, slight uneven color development or slight unrecorded area was observed and the solid pattern was printed almost evenly.

Fair: Uneven glossiness, uneven color development or unrecorded area was observed and the solid pattern was not printed evenly.

Poor: Much uneven glossiness, much uneven color development or much unrecorded area was observed.

<Printing Run-Ability>

The prepared thermosensitive recording medium was printed a solid pattern (Relative brightness: −15, Printing speed: 50 mm/sec, Size: 10 cm×10 cm) in the following two conditions ((1) and (2)) by using a label printer (140XiIII manufactured by Zebra Co., Ltd.). Then the extent of the occurrence of stick and the noise (stick sound) as well as the paper feed were evaluated on the following criteria:

(1) Relative brightness: 0, Printing speed: 50 mm/sec (2) Relative brightness: 30, Printing speed: 150 mm/sec The relative brightness is a factor corresponding to the energy intensity to be applied from the thermal head. For the print speed of 150 mm/sec (corresponding to high speed printing), the energy intensity applied from the thermal head was increased in order to obtain the same degree of color development sensitivity (recorded density) as that of the normal printing.

A: No or slight occurrence of stick, almost no noise (stick sound) and normal paper feed when printing.

B: No or slight occurrence of stick and almost no noise (stick sound), but inappropriate printing due to empty run and incorrect paper feed. When incorrect paper feed occurs, shrinkage of the image in print direction (vertical) is observed.

C: Occurrence of stick and noise (stick sound).

D: Occurrence of remarkable stick and large noise (stick sound).

The evaluation results are shown in Table 1.

TABLE 1

| | Intermediate layer | | Gloss layer | | | Evaluation | | | | | |
|---|---|---|---|---|---|---|---|---|---|---|---|
| | Carboxyl group-containing resin | Others | Long-chain alkyl group-containing resin | Silicone copolymer resin | Others | Color development sensitivity (Recorded density) | Glossiness blank portion | Glossiness printed portion | Print image quality | Printing run-ability 50 mm/sec | Printing run-ability 150 mm/sec |
| Example 1 | ASN1004K | — | S-310 | R170EM | — | 1.82 | 67 | 69 | Excellent | A | A |
| Example 2 | ASN1004K | — | S-310 | R170EM | — | 1.78 | 68 | 53 | Excellent | A | A |
| Example 3 | ASN1004K | — | S-310 | D-6040SP | — | 1.55 | 69 | 40 | Good | A | A |
| Example 4 | KL118 | — | S-310 | R170EM | — | 1.90 | 59 | 69 | Excellent | A | A |

TABLE 1-continued

| | Intermediate layer | | Gloss layer | | | Evaluation | | | | | |
|---|---|---|---|---|---|---|---|---|---|---|---|
| | Carboxyl group-containing resin | Others | Long-chain alkyl group-containing resin | Silicone copolymer resin | Others | Color development sensitivity (Recorded density) | Glossiness blank portion | Glossiness printed portion | Print image quality | Printing run-ability 50 mm/sec | Printing run-ability 150 mm/sec |
| Example 5 | KL118 | — | S-310 | R170EM | — | 1.82 | 61 | 48 | Excellent | A | A |
| Example 6 | KL118 | — | S-310 | D-6040SP | — | 1.60 | 63 | 35 | Good | A | A |
| Comparative Example 1 | ASN1004K | — | — | R170EM | — | 1.76 | 65 | 64 | Good | A | B |
| Comparative Example 2 | ASN1004K | — | S-310 | — | — | 1.52 | 66 | 24 | Fair | C | C |
| Comparative Example 3 | ASN1004K | — | — | — | — | 1.19 | 20 | 26 | Fair | D | D |
| Comparative Example 4 | KL118 | — | — | — | — | 1.50 | 10 | 18 | Fair | C | D |
| Comparative Example 5 | — | PVA117 | S-310 | R170EM | — | 1.84 | 57 | 63 | Good | A | C |
| Comparative Example 6 | ASN1004K | — | — | R170EM | Zinc laurate | 1.76 | 56 | 50 | Poor | A | B |
| Comparative Example 7 | ASN1004K | — | — | R170EM | Sodium dialkyl-succinate sulfonate | 1.80 | 64 | 44 | Fair | A | C |
| Comparative Example 8 | ASN1004K | — | — | R170EM | Polyglyceryl fatty acid ester | 1.81 | 61 | 42 | Fair | A | C |

Followings are derived from Table 1:

Thermosensitive recording medium having the intermediate layer and the gloss layer of the present invention has an increased glossiness in the blank and printed portions, superior color developing sensitivity and superior printing run-ability, particularly superior printing run-ability at high-speed printing.

When the gloss layer contains an emulsion type silicone copolymer resin but does not contain a long chain alkyl group-containing resin, the printing becomes inappropriate due to empty run and incorrect paper feed (Comparative Example 1). When the gloss layer does not contain a long chain alkyl group-containing resin or the gloss layer is not installed, Printing run-ability, Glossiness or Print image quality is poor (Comparative Example 2-4).

When the intermediate layer contains a binder other than a carboxyl group-containing resin, Printing run-ability at high-speed printing is poor (Comparative Example 5). When the gloss layer contains an emulsion type silicone copolymer resin and also so-called slipping agent (such as Zinc laurate, Sodium dialkylsuccinate sulfonate and Polyglyceryl fatty acid ester), Printing run-ability at high-speed printing is poor (Comparative Examples 6-8). Further when the gloss layer contains Zinc laurate, Print image quality becomes poor (Comparative Example 6).

What is claimed is:

1. A thermosensitive recording medium comprising, in order on a substrate: a thermosensitive recording layer comprising a colorless or pale colored leuco dye and an electron accepting color developing agent; an intermediate layer comprising a carboxyl group-containing resin; and, as the outermost layer, a gloss layer comprising a long chain alkyl group-containing resin and an emulsion type silicone copolymer resin, wherein the long chain alkyl group-containing resin is an acrylic resin containing long-chain alkyl group(s).

2. The thermosensitive recording medium of claim 1, wherein the carboxyl group-containing resin is an acrylic resin or a carboxy-modified polyvinyl alcohol.

3. The thermosensitive recording medium of claim 2, wherein the number of carbon atoms of the long-chain alkyl group(s) is from 6 to 30.

4. The thermosensitive recording medium of claim 2, wherein the silicone copolymer resin is a silicone-acryl copolymer resin and/or a silicone-urethane copolymer resin.

5. The thermosensitive recording medium of claim 1, wherein the acrylic resin containing long-chain alkyl group(s) is an acrylic acid ester copolymer resin containing long-chain alkyl group(s).

6. The thermosensitive recording medium of claim 5, wherein the number of carbon atoms of the long-chain alkyl group(s) is from 6 to 30.

7. The thermosensitive recording medium of claim 5, wherein the silicone copolymer resin is a silicone-acryl copolymer resin and/or a silicone-urethane copolymer resin.

8. The thermosensitive recording medium of claim 1, wherein the number of carbon atoms of the long-chain alkyl group(s) is from 6 to 30.

9. The thermosensitive recording medium of claim 1, wherein the silicone copolymer resin is a silicone-acryl copolymer resin and/or a silicone-urethane copolymer resin.

* * * * *